US008827652B2

(12) United States Patent
Witt

(10) Patent No.: US 8,827,652 B2
(45) Date of Patent: Sep. 9, 2014

(54) FAN BLADE AND ATTACHING MEANS THEREFOR

(76) Inventor: Henrik Witt, Hamburg (DE)

( * ) Notice: Subject to any disclaimer, the term of this patent is extended or adjusted under 35 U.S.C. 154(b) by 352 days.

(21) Appl. No.: 13/203,629

(22) PCT Filed: Feb. 26, 2010

(86) PCT No.: PCT/EP2010/001186

§ 371 (c)(1),
(2), (4) Date: Aug. 26, 2011

(87) PCT Pub. No.: WO2010/097225

PCT Pub. Date: Sep. 2, 2010

(65) Prior Publication Data

US 2011/0311365 A1 Dec. 22, 2011

(30) Foreign Application Priority Data

Feb. 26, 2009 (DE) ..... 10 2009 010 748

(51) Int. Cl.
*F04D 29/36* (2006.01)
*F04D 29/38* (2006.01)
*F04D 29/02* (2006.01)

(52) U.S. Cl.
CPC ..... *F04D 29/023* (2013.01); *F04D 29/388* (2013.01)
USPC ..... 416/204 R; 416/219 A

(58) Field of Classification Search
USPC ..... 416/248, 244 R, 220 A, 219 A, 209, 207, 416/205, 204 R, 210 R, 246
See application file for complete search history.

(56) References Cited

U.S. PATENT DOCUMENTS

| | | | | |
|---|---|---|---|---|
| 1,878,816 A * | 9/1932 | Bucklen | 416/207 |
| 2,115,454 A * | 4/1938 | Berliner | 416/204 R |
| 4,285,637 A * | 8/1981 | Thompson | 416/202 |
| 5,118,257 A * | 6/1992 | Blakeley et al. | 416/219 R |

FOREIGN PATENT DOCUMENTS

| | | |
|---|---|---|
| JP | 63170590 A * | 7/1988 |
| JP | 03286200 A * | 12/1991 |

* cited by examiner

*Primary Examiner* — Richard Edgar
(74) *Attorney, Agent, or Firm* — North Weber & Baugh LLP

(57) ABSTRACT

In order to disclose attaching means (3) for attaching a blade section (2) of a fan blade (1), in particular of a smoke extractor fan, to a fan hub, as well as a fan blade (1), which guarantee a high tensile strength even at high temperatures, wherein the attaching means (3) and fan blades (1) are to be produced so as to save as much weight as possible, it is proposed that the attaching means (3) have a connecting section (5) embodied to produce a high-tensile connection to a blade section (2) of a fan blade (1), which connecting section can be arranged essentially in the interior of the blade section (2).

16 Claims, 6 Drawing Sheets

FAN BLADE AND ATTACHING MEANS THEREFOR

CROSS REFERENCE TO RELATED APPLICATIONS

This application is the National Phase Application under 35 USC §371 of International Application No. PCT/EP2010/001186, filed Feb. 26, 2010, which claims priority to German Patent Application 10 2009 010 748.7, filed Feb. 26, 2009.

BACKGROUND

A. Technical Field

The present invention relates to attaching means for attaching a blade section of a fan blade, in particular of a smoke extractor fan, to a fan hub.

The invention also relates to a fan blade, in particular for smoke extractor fans, with attaching means for attaching the fan blade to a fan hub and with a blade section.

B. Background of the Invention

Fans for subways or tunnels and/or closed vehicle buildings, such as underground parking garages, for example, must operate reliably for extremely long service lives with a variety of load and ambient conditions. Typically, the installation of fans in subways, tunnels or underground parking garages is designed for an operation over several years or decades. In particular with the use of fans as a smoke extractor fan in subways or tunnels there are requirements on the part of the subway or tunnel operator for the operability of the fan at high temperatures, such as occur in particular in the case of fires. The requirements are in part stipulated by law.

On the other hand, as is generally customary, there is an effort to produce fans as cheaply as possible and as economically as possible in terms of materials. In general, fans are composed in terms of their basic structure of a fan hub, to which a number of generic fan blades are radially attached. The attachment of the generic fan blades is carried out with the aid of generic attaching means, which are usually embodied as blade bases.

Various fans are known against the background of the general requirements for fans described above. In order to keep the weight low, fans are known, the fan blades of which are cast solid of aluminum or an aluminum alloy. However, the disadvantage of fan blades made of aluminum is their limited usability at temperatures above approx. 300° C. The tensile strength of aluminum decreases considerably at the cited temperatures, so that the aluminum gradually begins to flow. Even special aluminum alloys, such as sand-casting alloy, cannot substantially improve this inadequacy. As a result of this disadvantageous property of aluminum, fan blades produced of cast aluminum can be detached from the hub at high temperatures, such as can occur in the event of fires.

Due to this inadequacy of fan blades made of aluminum, in the prior art for smoke extractor fans under high stresses, that is, at high speeds and/or with large blade lengths, fan blades cast solid from steel are used. However, fans with solid cast steel blades are disadvantageously very heavy.

From DE 10 2004 010 397 A1 a blade is known for the blade wheel of a fan, in which an inner support part composed of a tough, high-strength material is cast around by an outer part of aluminum or a comparable light metal alloy such that it is embedded therein. The inner support part in turn is composed of two plates, which are inserted into one another through slots formed in each plate such that they are at right angles to one another seen in the direction of sight of the blade axis. The known blade is connected to the hub in that it is clamped between two hub bodies by compression. To this end the two hub bodies must be present disadvantageously as cast parts or they must be embodied expensively as a welded construction. This is unfavorable in particular with the individual production of large fans or with small batches.

SUMMARY OF THE INVENTION

The object of the present invention is therefore to disclose attaching means for attaching a blade section of a fan blade, in particular of a smoke extractor fan, to a fan hub as well as a fan blade of the type mentioned at the outset which avoid the cited problems. In particular with the attaching means according to the invention and the fan blade according to the invention a high tensile strength is to be guaranteed even at high temperatures and rotational speeds, wherein the attaching means and fan blades are to be produced so as to save as much weight as possible. Furthermore, it should be possible to produce the attaching means cost-effectively, in order in particular to be economically suitable for individual production as well.

According to the invention this object is attained with attaching means of the type mentioned at the outset in that they have a connecting section embodied to produce a high-tensile connection to a blade section on the fan blade, which connecting section can be arranged essentially in the interior of the blade section. Advantageously, it is therefore proposed according to the invention to embody the attaching means separately from the actual fan blade at least in the production process. This advantageously makes it possible to select a material optimized for the purposes of attaching the fan blade to the fan hub as well, independently thereof, to select a material optimized for the fan blade region. In particular the attaching means can be advantageously selected from a material with high hot-tensile strength and good creep behavior at high temperatures. For this purpose at the same time a particularly light material can be selected for the fan blade without the stability of the fan as a whole being impaired thereby.

According to the invention it is particularly favorable if the attaching means are embodied for casting with a blade section of a fan blade. In this case, the attaching means according to the invention can be used to attach solid cast fan blades to the corresponding fan hubs. The pouring in of the connecting section of the attaching means according to the invention in the fan blade ensures a firm connection of the fan blade to the attaching means and thus indirectly to the fan hub.

It is particularly favorable for the hot-tensile strength and the creep behavior of the fan according to the invention if the attaching means according to the invention are made essentially of steel.

In a preferred embodiment of the attaching means according to the invention, the connecting section is embodied to be essentially flat and/or plate-like and/or conical. In particular a plate-like embodiment of the attaching means makes it possible to produce a high-tensile connection to the fan blade when the attaching means is cast with the fan blade.

In a preferred embodiment of the attaching means according to the invention, the high-tensile connection between the blade section of the fan blade and the connecting section of the attaching means is designed particularly securely when at least one of the boundaries, aligned essentially in the radial direction, of the connecting section has a curved course in the axial and/or radial projection. The connection of the attaching means made of steel, for example, by means of casting with a blade section of a fan blade made of aluminum, for example, is thereby embodied in a particularly durable manner. For example, the edges can have spikes or the like.

Through the measure that according to the invention the course has essentially a sawtooth-shape, when casting the attaching means with a fan blade a connection in the manner of a barbed hook is obtained. Expediently, the sawtooth form is oriented such that with the forces acting radially outwards in operation between the fan blade and the attaching means according to the invention counteracts.

With the casting of the attaching means according to the invention with a fan blade, in another favorable embodiment of the invention a particularly high-tensile connection is obtained in that the connecting section has a changeable width in the radial direction.

In another favorable embodiment of the invention, to this end the width of the connecting section is embodied in a manner tapering radially outwards at least in some sections.

A further improvement of the tensile strength and connection between the attaching means and a fan blade is obtained within the scope of the invention if the connecting section has cutouts, in particular bores. With the casting of the attaching means with the fan blade, the cutouts act like fastening eyelets. Within the scope of the invention various embodiments of the cutouts are possible. For example, two radially oriented rows of bores running essentially parallel to one another can be provided. With other attaching means according to the invention, a single bore along the radial axis of the attaching means has proven to be favorable.

According to an advantageous variant of the invention, the connecting section has a twist, wherein the twist is preferably adapted to a twist of the blade section of a fan blade. In this manner the attaching means according to the invention can advantageously also be used as a skeleton, as it were, for axial fan blades with a shape that is twisted for aerodynamic reasons.

If, in further advantageous embodiment of the invention, the attaching means have a base section, adjoining the connecting section in the radial direction, with an elongated attaching element running essentially radially for attaching a fan blade to a fan hub, the attachment of the fan blade with the aid of the attaching means according to the invention to the fan hub is particularly favorable. The attaching element can be embodied as blade bolts with a straight or conical seat. The attaching element running radially can be embodied as a twisted blade bolt. The blade bolt can be embodied in one piece with the connecting section of the attaching means or welded to the connecting section, for example. Advantageously, the hub can therefore be embodied cost-effectively in one piece, wherein mounting holes for inserting the base section of the attaching means according to the invention have to be provided only in the radial direction. Within the scope of the invention a threaded connection between the base section and the mounting holes can also be realized. To this end, an external thread can be shaped in the region of the base section.

In a further advantageous embodiment of the invention the base section can be composed of a first conical section and preferably a second conical section adjoining it in the radial direction, in particular with a smaller diameter than the first conical section.

In another preferred embodiment of the invention, a support seat adjoins the second conical section, tapered compared to the first conical section, in the radial direction.

In a further development of the invention the support seat can be embodied as a cylindrical seat and in particular be rigidly connected to the first and/or second conical section. With the assembly of a fan blade according to the invention to a hub by simple insertion of the base section into suitable openings inside the hub, the support seat is advantageously used to prevent an initial tension of the connecting section relative to the blade section.

In order to prevent the fan blade from being given an initial tension during the attachment to the fan blade with the aid of the attaching means according to the invention, within the scope of the invention the base section can be provided with a lock nut for screwing the attaching means to a fan hub. The decisive factor is that the lock nut is firmly connected to the attaching means so that a loss of prestress of the fan blade is effectively avoided.

In another favorable embodiment of the invention the attaching means is embodied tapering radially outwards, in particular essentially conically. This measure, in particular with casting with a fan blade, also leads to a high-tensile connection between these components.

In a further embodiment of the invention, the width of the connecting section can thereby be embodied tapering radially outwards, at least in some regions. For example, the attaching section can have the shape of a flat plate with the contours of a pine tree.

The object of the invention is also attained with a fan blade, in particular for smoke extractor fans, with attaching means for attaching the fan blade to a fan hub as well as with a blade section in which the attaching means are made essentially from a different material than the blade section. Through this measure, a material with particularly high hot-tensile strength and good creep strength at higher temperatures can be selected for the attaching means. On the other hand, a material can be selected for the blade section, which is selected according to different criteria, for example, to reduce the weight.

In particular in a preferred embodiment of the invention the fan blade can be provided with attaching means, which are embodied according to one of claims 1 through 13.

Preferably, within the scope of the invention the attaching means can be embodied cast with the blade section.

In an embodiment of the fan blade according to the invention that is particularly suitable for smoke extractor fans, the blade section is made from a material with a lower density compared to steel, in particular aluminum. The weight of the fan can thereby be kept low while at the same time retaining a necessary high tensile strength at high temperatures.

The invention is described in a preferred embodiment with reference to a drawing by way of example, wherein further advantageous details can be taken from the figures of the drawing.

Functionally identical parts are provided with the same reference numbers.

BRIEF DESCRIPTION OF THE DRAWINGS

Reference will be made to embodiments of the invention, examples of aspects of which may be illustrated in the accompanying figures. These figures are intended to be illustrative, not limiting. Although the invention is generally described in the context of these embodiments, it should be understood that the scope of the invention is not limited to the particular embodiments thereof disclosed herein.

FIG. 3 Another embodiment of an attaching means according to the invention with a lock nut welded on;

DETAILED DESCRIPTION OF THE PREFERRED EMBODIMENTS

Figure 1:
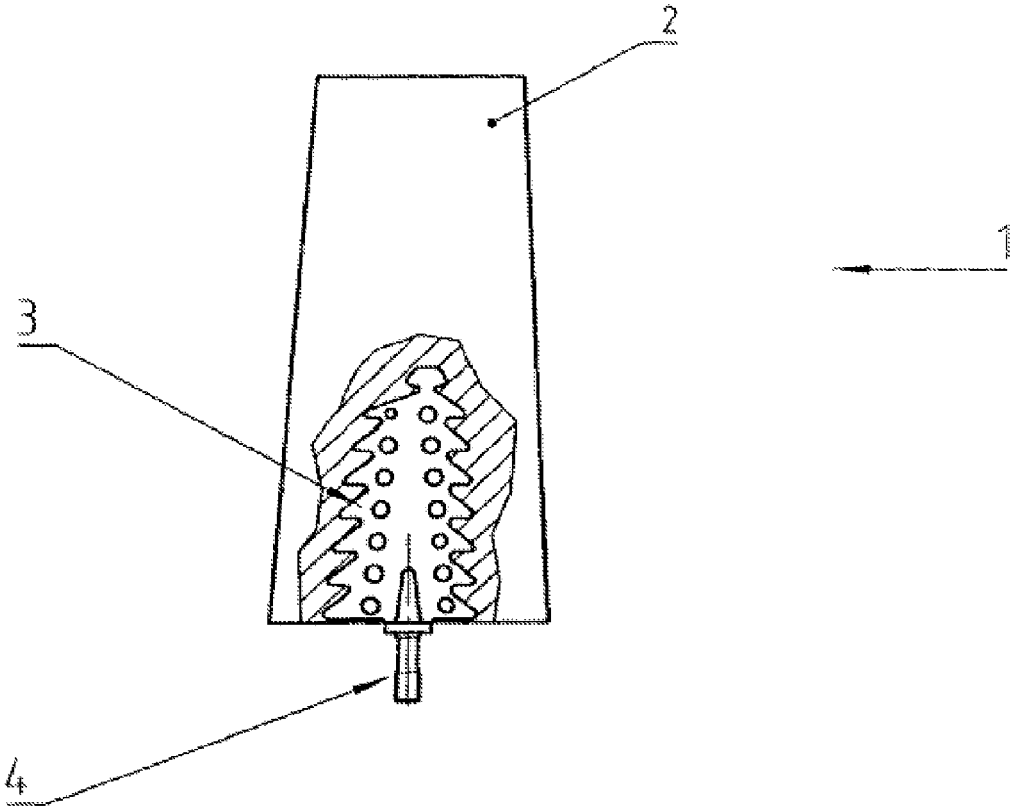
FIG. 1 A fan blade according to the invention with an attaching means according to the invention in a partial elevation view.

The figure shows diagrammatically in a plan view a fan blade 1 with a blade section 2 and an attaching part 3. The representation is a partial elevation drawing. In the following radial direction always means a radial direction based on a fan blade, corresponding to a longitudinal axis of the blade section 2 in FIG. 1. Likewise, axial direction means the axial direction of the complete fan. FIG. 1 therefore shows that the attaching part 3 is located in the interior of the solid blade section 2. To produce the fan blade 1, the attaching part 3 is cast with the blade section 2 during the casting of the blade section 2.

The attaching part 3 is cast with the blade section 2 such that a base section 4 projects out of the radial inner front face of the blade section 2. With base section 4, the fan blade 1 is usually inserted into a fan hub (not shown) and fixed there. In the exemplary embodiment the blade section 2 of the fan blade 1 is essentially composed of aluminum. On the other hand, the attaching part 3 as well as the base section 4 of the attaching part 3 is composed of steel. The attaching part 3 is thus made of a material with much higher tensile strength than the blade section 2. The attaching part 3 thus acts as an inner steel skeleton, which guarantees sufficient tensile strength during the operation of the fan blade 1. In particular the hot-tensile strength of the attaching part 3 made of steel is guaranteed at temperatures of approx. 300° C. or even 400° C. On the other hand, the blade section 2 made of aluminum exhibits only inadequate hot-tensile strength at the cited temperatures. It has proven to be advantageous if the attaching part 3 is composed of a soft steel, such as of strength class 5.6 according to DIN ISO 898 part 1 1988. Harder steels, such as of strength class 8.8, in contrast have proven to be too brittle.

With reference to FIGS. 2 to 5 the special embodiment according to the invention of the attaching part 3 is explained below in various embodiments.

Figure 2:
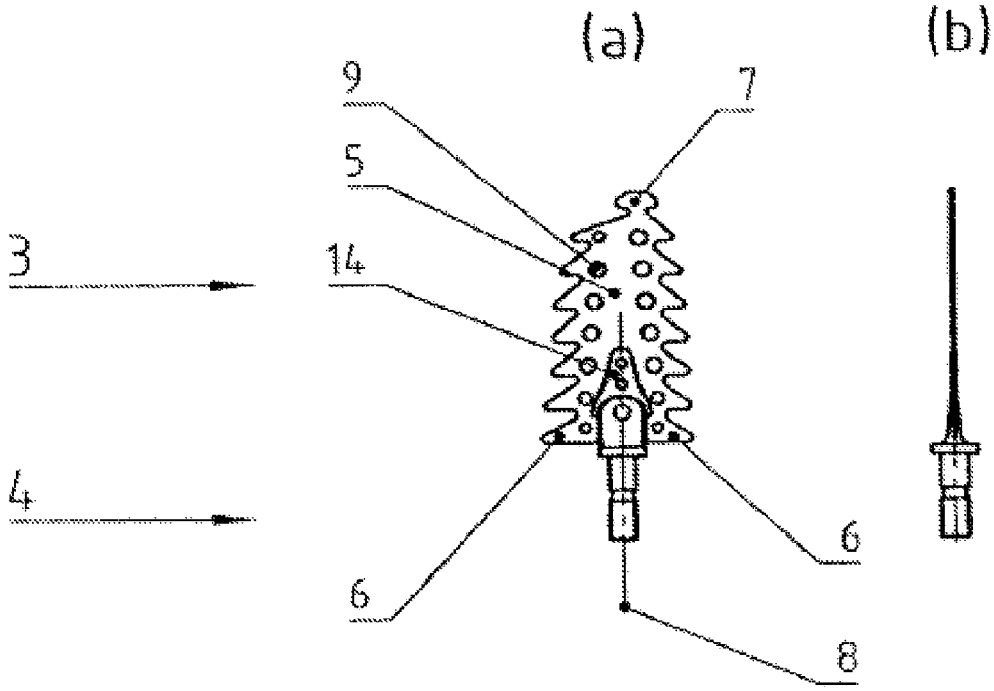
FIG. 2 The attaching means according to the invention of the fan blade from FIG. 1 in (*a*) a plan view and (*b*) a side view.

FIG. 2 shows the attaching part 3 of the fan blade 1 according to FIG. 1 (*a*) in a plan view according to the perspective from FIG. 1 as well as (*b*) in a view turned by 90 degrees about the longitudinal axis compared to the view according to part (*a*) of FIG. 2. It can be seen from the two views (*a*) and (*b*) of FIG. 2 that the attaching part 3 is composed of a connecting section 5 and a base section 4. The connecting section 5 and the base section 4 are respectively composed of a soft steel of strength class 5.6. The connecting section 5 has the shape of a flat plate. The edges running essentially in the radial direction of the blade section 2 during assembly respectively have a number of spikes 6. Overall, due to the spikes 6, the shape of the plate-like connecting section 5 is reminiscent of the edges on a pine tree. On the radially outermost end of the plate-like connecting section 5 of the attaching part 3, the connecting section 5 has a rounded tip 7. The connecting section 5 is embodied asymmetrically. That is, there is no mirror symmetry along a radial line 8.

Bores 9 are made in the connecting section 5. The bores are arranged approximately equidistantly in two rows running parallel to one another in the radial direction.

The base section 4 is welded to the connecting section 5.

Figure 3:
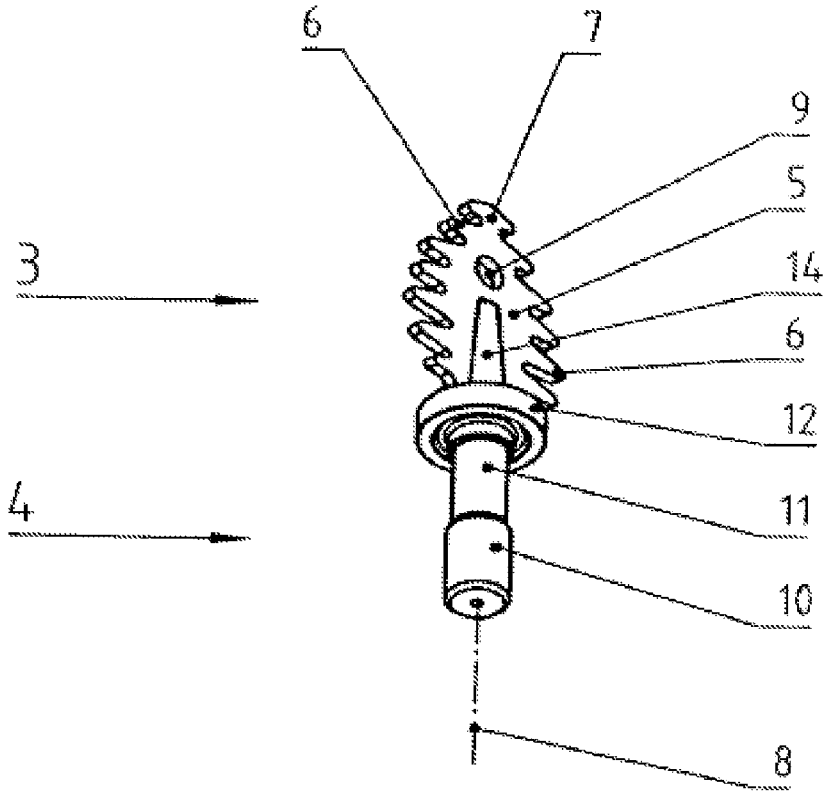

A different embodiment of the attaching part 3 according to the invention is shown in FIG. 3. The structure corresponds essentially to that of the attaching part 3 shown in FIG. 2. Whereas FIG. 2 shows the attaching part 3 in a plan view, FIG. 3 is a perspective view. Deviating from the attaching part 3 according to FIG. 2, the attaching part 3 according to FIG. 3 has a single bore 9. This is located on the central axis 8 of the attaching part 3.

The spiked shape of the connecting section 5 is mirror symmetrical on both edges along the radial line 8. The base section 4 is composed of a conical section 10 and a further conical section 11 adjoining it along the radial line 8 with a smaller diameter than the conical section 10. Along the radial line 8, a support seat 12 adjoins the conical section 11 tapered compared to the conical section 10. The cylindrical seat 12 is rigidly connected to the conical section 11. In the assembly of the fan blade 1 to a hub, not shown in the figures, by inserting the base section 4 into suitable openings inside the hub, the cylindrical seat 12 is used to prevent an initial tension of the connecting section 5 relative to the blade section 2. Advantageously, the hub can therefore be embodied cost-effectively in one piece, wherein mounting holes for the insertion of the base section need to be provided only in the radial direction. Within the scope of the invention, a threaded connection between the base section and the mounting holes can also be realized.

Figure 4:
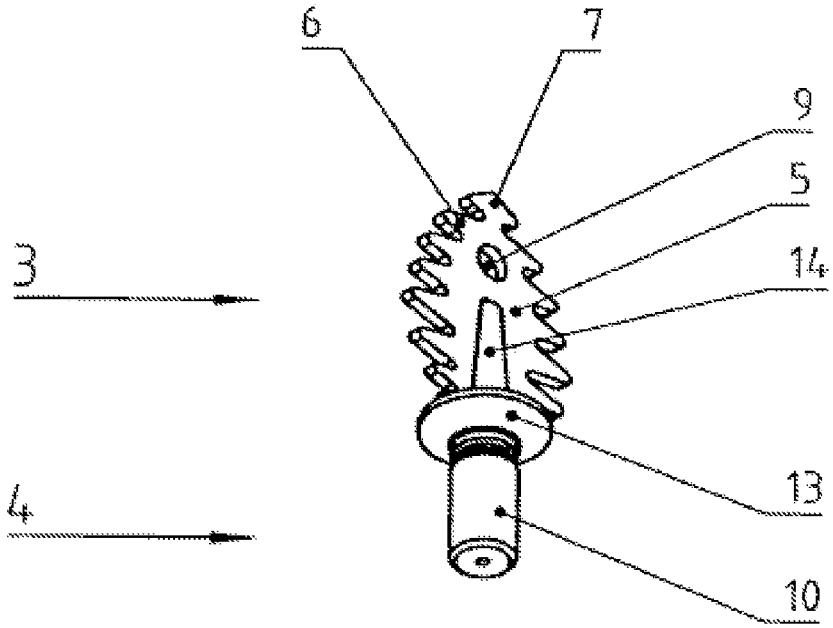
FIG. 4 A further embodiment of an attaching means according to the invention in a perspective view with conical seat.

FIG. 4 shows a further embodiment of the attaching part 3, likewise in a perspective view. The structure of the connecting section 5 corresponds to that of the connecting section 5 of the attaching part 3 shown in FIG. 3. Deviating from the attaching part 3 shown in FIG. 3, the base section 4 of the attaching part 3 shown in FIG. 4 has a conical seat section 13. The conical seat section 13 is used analogously to the cylindrical seat section 12 of the embodiment according to FIG. 3 to securely screw the blade section 2 of the fan blade 1 without initial tension to a hub, not shown, or to connect it to the hub in another manner.

In FIG. 4 it can be seen particularly well that in the extension of the conical section 10 of the base section 4 a wedge section 14 tapering conically in the radial direction is used to attach the connecting section 5 to the base section 4 of the attaching part 3. The wedge section 14 is provided in the radial direction with a receptacle for the plate-like connecting section 5. The connection is produced by welding. The described wedge section 14 is also present with the attaching parts according to FIG. 2 and FIG. 3.

Figure 5:
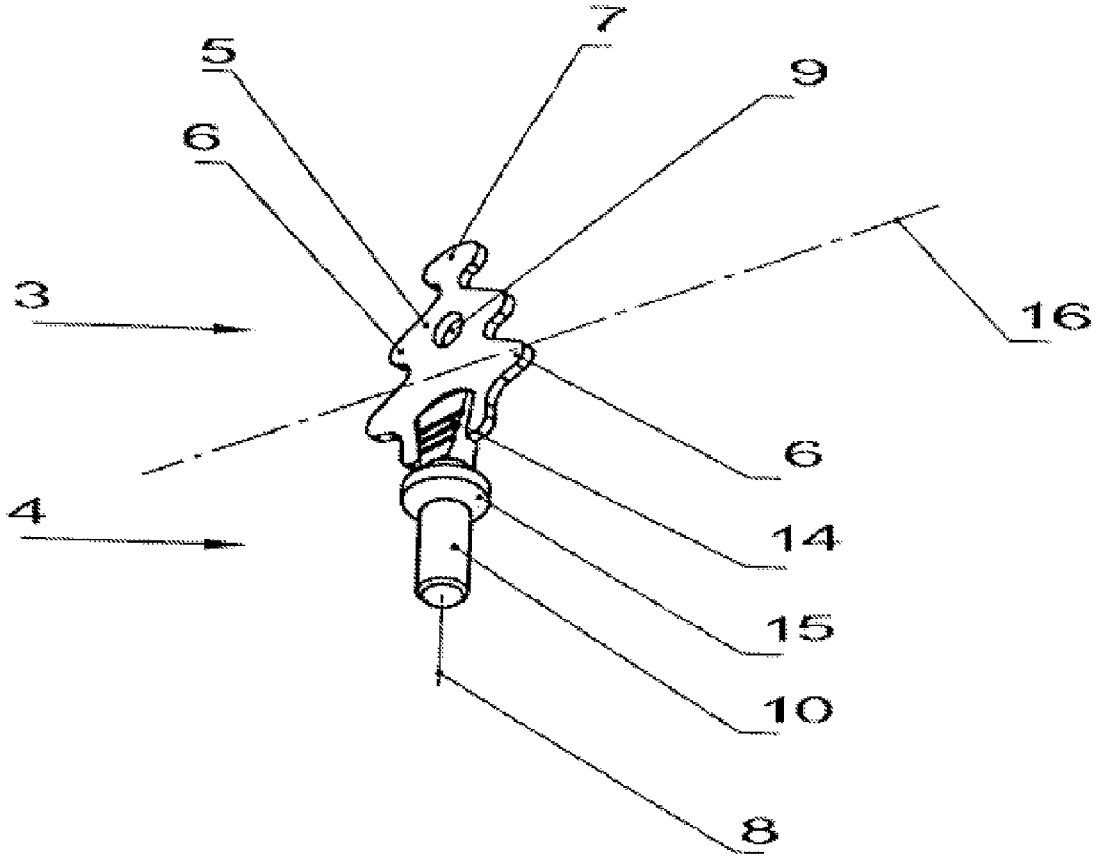
FIG. 5 A further embodiment of an attaching means according to the invention with a counter sunk nut.

Finally, FIG. 5 shows a further embodiment of the attaching part 3 according to the invention. The basic structure corresponds to the attaching parts 3 shown in FIGS. 2 through 4. A counter sunk nut 15 adjoins the conical section 10 in the direction of the connecting section 5. The pine tree shape of the connecting section 5 is symmetrical along the radial line 8. Deviating from the embodiments of the attaching part 3 shown in the FIGS. 2 through 4, however, only two spikes per edge are present, which taken individually have a mirror symmetry along an axial line 16.

The attaching parts according to the invention in one of the embodiments according to FIGS. 2 through 5 are very suitable for producing a high-tensile connection to the blade section 2 of the fan blade 1.

The connection between the blade section 2 and the connecting section 5 is thereby produced by casting with the production of the fan blade 1. A blade section 2 is cast in a usual metal mold in the usual manner. The attaching part 3 according to the invention is thereby placed in the metal mold in suitable manner. If according to the described exemplary embodiment the blade section 2 is cast from aluminum, the aluminum passes through the cutouts 9, which have the shape of bores, and when the casting compound hardens respectively forms bolt-like attachments of the blade section 2 to the connecting section 5. Furthermore, during the casting in the spaces of the spikes 6 of the connecting section 5 of the attaching part 5 a profile is produced that is complementary to the spikes 6, which interacts in a tooth-like manner with the spikes 6 of the connecting section 5 of the connecting part 3.

During the operation of the fan with the fan blade 1 according to the invention, the attaching part 3 made of steel exerts a centripetal force in the direction of the hub on the blade section 2 of the fan blade 1. The blade section 2 is thereby held securely to the hub, not shown, even at high speeds. The connection is still secure even at high temperatures, for example at 400° C. The hot-tensile strength of steel, such as of strength class 5.6, is still excellent in the referenced temperature range. The special shaping of the spikes 6, which in the case of the attaching part 3 according to FIG. 2 have a slope in the manner of a barbed hook, secures the blade section 2 reliably in this manner.

According to the invention, an attaching part 3 as well as a fan blade 1 is thus proposed which can be used reliably over a temperature range up to at least 400° C. In particular a use in smoke extractor fans is thus advantageously possible.

The conical section 10 of the base section 4 can be secured with setscrews against twisting in the hub, not shown. According to this embodiment variant, the conical section 10 of the base section 4 is flattened to engage the setscrews.

An embodiment of an attaching part 3 according to the invention with a twisted connecting section 5, not shown in the figures, would render a twist discernible in the view according to FIG. 2 (*b*) which corresponds to a profiling of the blade section 2 of the fan blade 1.

Figure 6:
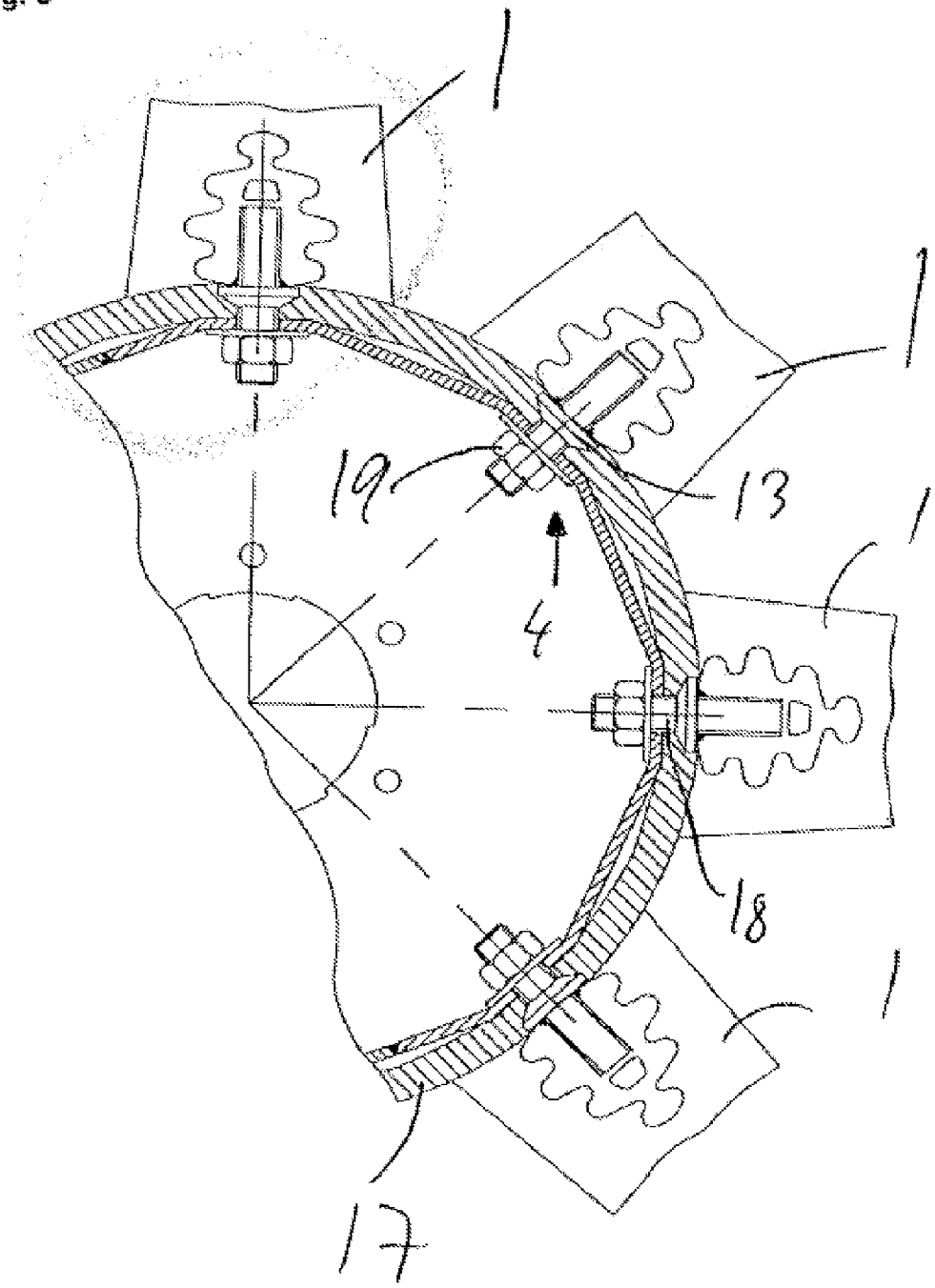
FIG. 6 Axial section through a fan hub with a fan blade according to the invention mounted therein.

FIG. 6 illustrates in an axial section through a fan hub 17 how fan blades 1 according to the invention with a conical seat 13, such as embodied with the attaching part 3 shown in FIG. 4 for example, are attached to the fan hub 17. Advantageously, the fan hub 17, as discernible in FIG. 6, is essentially embodied in one piece. To accommodate the fan blades 1 it has respectively one bore 18. The bores 18 can be inserted in the fan hub 17 cost-effectively during production. Fans with fan blades 1 according to the invention can thereby also be produced economically in an individual production or in small batches. The fan blades 1 are inserted from outside into the bores 18 with the base section 4, so that the conical seat 13 bears against the edge of the bore 18. The conical seat 13 is attached to the fan hub 17 by means of a lock nut 19 such that the fan blade 1 does not exhibit any initial tension.

What is claimed is:

1. A fan blade comprising:

a blade comprising a blade section;

an attachment device comprising a connecting section arranged essentially in the interior of the blade section and a base section having an elongated attaching element running essentially radially to a first side of the base section, the base section comprises a first conical sectional and a second conical section in a radial direction, the second conical section having a smaller diameter than the first conical section; and wherein the attachment device is made of a different material than the blade.

2. The fan blade of claim 1 wherein the attachment device is made from steel.

3. The fan blade of claim 2 wherein the blade is made from aluminum.

4. An attachment device for attaching a blade section of a fan blade to a fan hub, the device comprising:

a connecting section that produces a high-tensile connection to a blade section of a fan blade, the connecting section being arranged essentially in an interior of the blade section;

a base section coupled to the connecting section in a radial direction, the base section having an elongated attaching element running essentially radially to a first side of the base section, the base section attaches the fan blade to the fan hub and comprises a first conical sectional and a second conical section in a radial direction, the second conical section having a smaller diameter than the first conical section; and wherein the base section is provided as an attachment in radial mounting bores of the fan hub.

5. The attachment device of claim 4 wherein an external thread is formatted in the base section.

6. The attachment device of claim 4 wherein a support seat adjoins the second conical section, the second conical section being tapered in the radial direction relative to the first conical section.

7. The attachment device of claim 4 further comprising a support seat that is cylindrical and is coupled to the first or second conical section.

8. The attachment device of claim 4 wherein the connecting section is made essentially of steel.

9. The attachment device of claim 4 wherein at least one boundary of the connecting section has a curved member projecting in an axial or radial direction.

10. The attachment device of claim 9 wherein the curved member has essentially a sawtooth shape.

11. The attachment device of claim 4 wherein the connecting section has a changeable width in a radial direction.

12. The attachment device of claim 11 wherein the changeable width of the connecting section is embodied in a manner tapering radially outwards at least in some sections and the connecting section has a plurality of cutouts.

13. The attachment device of claim 12 wherein the plurality of cutouts are bores.

14. The attachment device of claim 4 wherein the connecting section has a first twist member that fits with a second twist member of the fan blade.

15. The attachment device of claim 4 wherein the base section has a lock nut for screwing an attachment member of the fan hub.

16. The attachment device of claim 4 wherein the connecting section tapers radially outwards in a conical arrangement.

* * * * *